US010792558B1

(12) United States Patent
Goldstein

(10) Patent No.: US 10,792,558 B1
(45) Date of Patent: Oct. 6, 2020

(54) FOLDING DICE TOWER

(71) Applicant: Avraham Goldstein, Flushing, NY (US)

(72) Inventor: Avraham Goldstein, Flushing, NY (US)

( * ) Notice: Subject to any disclaimer, the term of this patent is extended or adjusted under 35 U.S.C. 154(b) by 0 days.

(21) Appl. No.: 16/692,395

(22) Filed: Nov. 22, 2019

(51) Int. Cl.
*A63F 9/04* (2006.01)

(52) U.S. Cl.
CPC ..... *A63F 9/0406* (2013.01); *A63F 9/0402* (2013.01); *A63F 9/04* (2013.01); *A63F 2009/0408* (2013.01)

(58) Field of Classification Search
CPC .. A63F 9/0406; A63F 2009/0408; A63F 9/04; A63F 9/0402
USPC ..... 273/145 B, 145 R, 145 C; D21/372
See application file for complete search history.

(56) References Cited

U.S. PATENT DOCUMENTS

| | | | | | |
|---|---|---|---|---|---|
| 709,633 | A * | 9/1902 | Haskell | A63F 9/0406 | 273/145 B |
| 2,241,567 | A * | 5/1941 | Wobensmith | A63F 9/0406 | 273/145 B |
| 3,468,543 | A * | 9/1969 | Dove | A63F 9/0406 | 273/145 R |
| 5,082,288 | A * | 1/1992 | Swartz | A63F 9/0402 | 273/145 B |
| 5,100,141 | A * | 3/1992 | Fitch | A63F 9/0406 | 273/145 B |
| 7,717,426 | B1 * | 5/2010 | Malmloff | A63F 9/0406 | 273/145 B |

* cited by examiner

*Primary Examiner* — Benjamin Layno

(57) ABSTRACT

Dice towers that are configured to fold into a flattened state during non-use are disclosed. The dice towers include a top end having a first opening that is configured to receive dice; a body section that includes an internal area that is contiguous with the first opening of the top end; and a bottom end having a second opening that is contiguous with the internal area and is configured to expel dice that have been dropped into the first opening. The dice tower is configured to fold into a flattened state during non-use, along a series of hinges that run vertically along the body section of the dice tower.

14 Claims, 7 Drawing Sheets

FOLDING DICE TOWER

FIELD OF THE INVENTION

The field of the present invention relates to dice towers, which are used to roll dice associated with board games. More particularly, the field of the present invention relates to portable dice towers, which are adapted to be easily packed and transported from one place to another.

BACKGROUND OF THE INVENTION

A dice tower is a device that is frequently used by individuals playing board games, which is designed to roll dice fairly. When using a dice tower, dice are dropped into the top of the tower, and allowed to descend and make contact with an interior area of the tower and/or various surfaces therein, before the dice emerge from a front and/or bottom portion of the tower. Players of board games favor dice towers because they provide a uniform way for each player to "roll the dice" and, simultaneously, prevent some methods of cheating that can be deployed when rolling dice by hand.

A typical dice tower exhibits a three-dimensional shape that makes transporting the dice tower cumbersome, e.g., when traveling or otherwise transporting the tower from one place to another. As such, there is a continuing need in the marketplace for improved dice towers, and particularly dice towers that are adapted to be easily packed and transported (in a manner that takes up only minimal space).

As the following will demonstrate, the devices of the present invention address these (and other) needs in the marketplace.

SUMMARY OF THE INVENTION

According to certain aspects of the present invention, dice towers that are configured to fold into a flattened state during non-use are provided. The dice towers include a top end having a first opening that is configured to receive dice; a body section that includes an internal area that is contiguous with the first opening of the top end; and a bottom end having a second opening that is contiguous with the internal area and is configured to expel dice that have been dropped into the first opening. The dice towers are preferably configured to reversibly fold into a flattened state during non-use, along a series of hinges that run from a top to bottom area of the body section.

More particularly, according to such aspects of the invention, the bottom end of the dice towers include a slanted platform, which is configured to make contact with and project the dice forward and out of the second opening. The invention provides that the top end further includes a cap, with the cap including a first hinge and the first opening. The invention provides that the cap is configured to reversibly swing into an open state and a closed state along the first hinge. The body section of the dice tower includes a plurality of sides, e.g., three, four, or more sides, with each of the sides having a folding hinge that runs vertically—i.e., from a bottom point to a top point of each of the sides.

The invention provides that each folding hinge (of each side) is configured to allow the body section to fold into the flattened state when the cap is converted into an open state. In such embodiments, the cap will preferably include a mechanical engagement located on a flap portion of the cap, with the mechanical engagement being configured to reversibly connect the flap portion of the cap to an external surface of the body section (namely, the front external side of the dice tower). According to certain preferred embodiments, the body section may further include a recessed area within the bottom-most area of at least two sides of the body section (preferably the sides opposite of each other), with the recessed area being configured to receive and nestably mate with a lip or perimeter wall of a dice tray.

According to additional aspects of the invention, dice tower and dice tray assemblies are provided. More particularly, the invention further encompasses the dice trays and dice towers described herein, being packaged and/or sold together.

The above aspects of the present invention are described and exemplified further in the Detailed Description set forth below.

DETAILED DESCRIPTION OF THE INVENTION

The following will describe, in detail, several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used, and made without departing from the scope and spirit of the invention.

Figure 9:
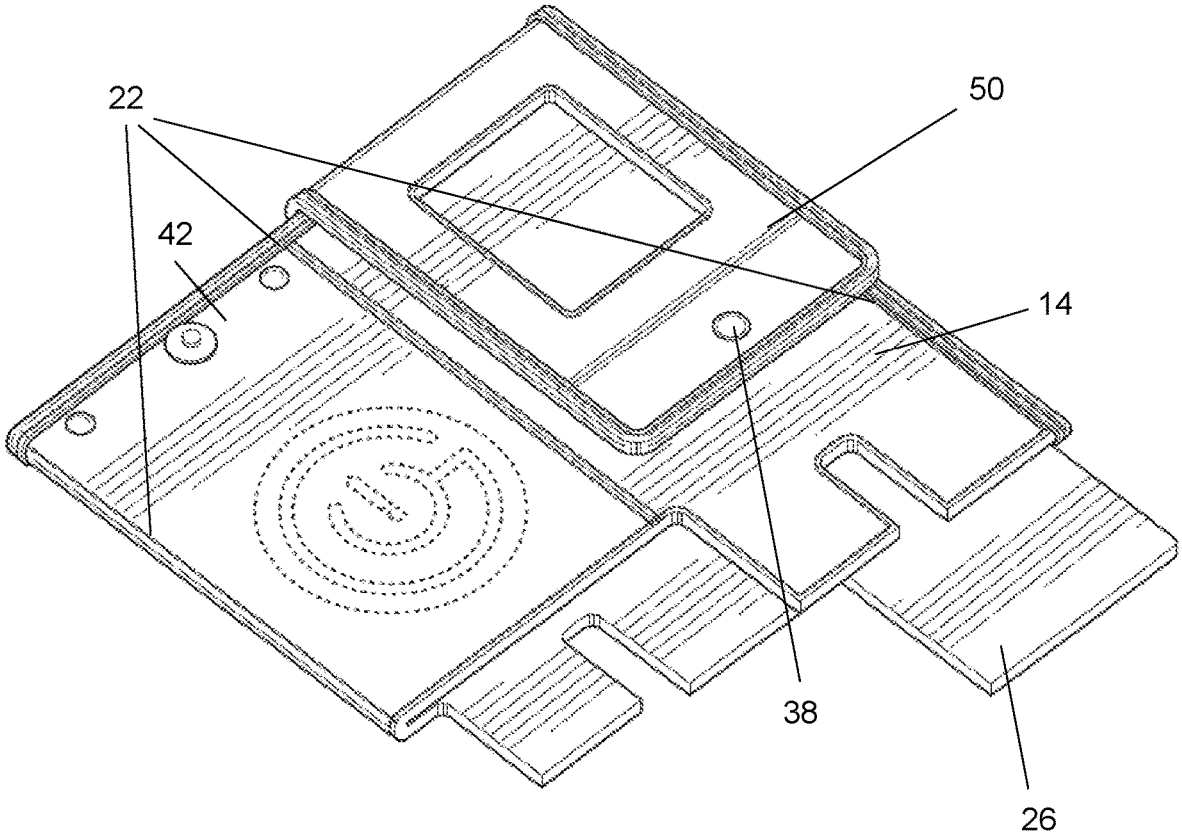
FIG. 9 is an elevated perspective view of the dice tower of the present invention, in a folded and collapsed state.

Referring now to FIGS. 1-11, according to certain preferred embodiments of the present invention, portable dice towers are provided, which are configured to fold into a flattened state during periods of non-use (to facilitate transport of the dice towers, while taking up a minimal amount of space). As used herein, the term "flattened state" includes a position in which certain walls of the dice tower are resting adjacent to each other, as generally illustrated in FIG. 9. The dice towers generally include a top end 10 having a first opening 12 that is configured to receive dice. Although the first opening 12 in the appended Figures is shown to exhibit a rectantangular perimeter, the invention provides that such first opening 12 may also exhibit other shapes and sizes, such as circular, triangular, or irregular openings.

The invention provides that the dice towers of the present invention further include a body section 14, which includes an internal area 16 that is contiguous with the first opening 12 of the top end 10. The dice towers further include a bottom end 18 having a second opening 20 that is contiguous with the internal area 16 and is configured to expel dice that have been dropped into the first opening 12. According to certain preferred embodiments, as mentioned above, the dice towers are configured to reversibly fold into a flattened state (FIG. 9) during non-use, along a series of hinges 22 that run from a bottom point 24 to a top point 26 of the body section 14 (i.e., of each wall of the body section 14). As used herein, the term "hinge" includes a conventional mechanical hinge, as well as creases, folds, depressions, or other mechanisms that allow two sides to rotate about an axis that is formed by the hinge, as described and illustrated herein.

According to certain preferred embodiments of the present invention, the bottom end 18 of the dice towers include a slanted platform 26, which is configured to make contact with the dice and project the dice forward and out of the second opening 20. The invention provides that the slanted platform 26 will includes its own hinge that attaches to a point within the internal area 16—which is configured to allow the slanted platform 26 to rest in a slanted/angled position when the dice tower is being used (FIG. 1), and rotate into a position that is adjacent and/or parallel to the walls of the dice tower when converted into a flattened state during non-use (FIG. 9).

Figure 1:
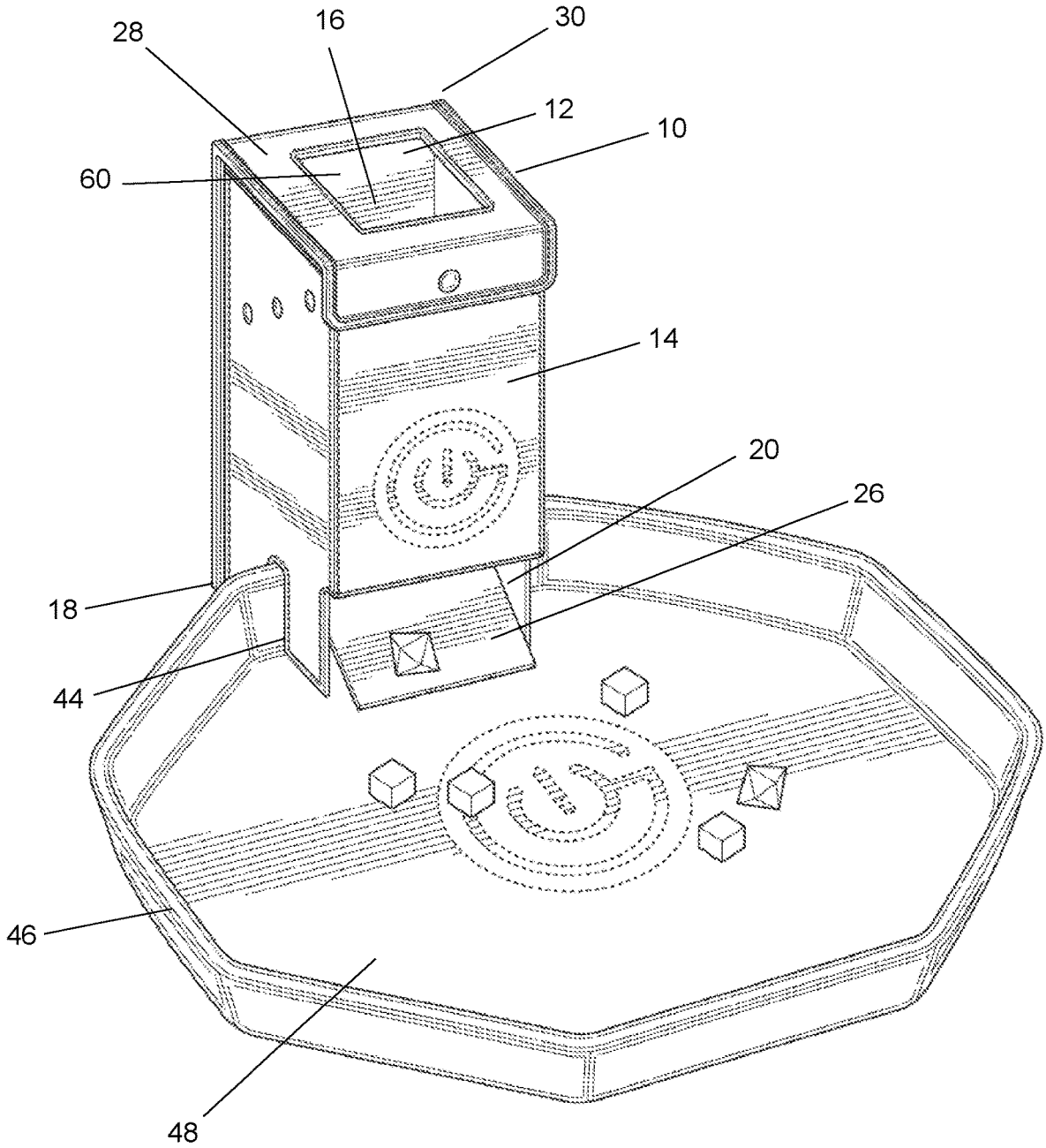
FIG. 1 is an elevated perspective view of the dice tower of the claimed invention, positioned over the perimeter wall of a dice tray.

The invention provides that the internal area 16 may, optionally, include additional platforms and surfaces therein, which are configured to contact dice as they travel through the internal area 16. For example, in certain preferred embodiments, a ramp 60 exists near the first opening 12 of the top end 10 (see FIGS. 1, 2, and 11). When the dice tower is being used and exists in an operable configuration (FIG. 1), the ramp 60 will make first contact with dice that have been dropped into the first opening 12, with the ramp 60 being configured to create a more desirable roll or path for the dice to take (versus dropping straight down). As mentioned further below, in such embodiments, the ramp 60 includes a series of hinges (e.g., creases) that enable the ramp 60 to automatically spread out when the dice tower is being used and exists in an operable configuration (FIG. 1). In addition, the series of hinges (e.g., creases) also enable the ramp 60 to automatically fold into a flattened state, when the rest of the dice tower is converted into a flattened state as described herein—such that the ramp 60 exhibits a sort of origami design and functionality.

According to certain preferred embodiments, the invention provides that the top end 10 further includes a cap 28, with the cap 28 having a first hinge 30 and the first opening 12 discussed above. The invention provides that the cap 28 is configured to reversibly swing into an open state (FIGS. 10 and 11) and into a closed state along the first hinge 30. Still further, the invention provides that the body section 14 of the dice towers will preferably include a plurality of sides 32, e.g., three, four, or more sides 32, with each of the sides 32 having a folding hinge 22 that runs from a bottom-most point 24 to a top-most point 26 of each of the sides 32 (which form the body section 14). The invention provides that each folding hinge 22 (of each side 32) is preferably configured to allow the body section 14 to fold into the flattened state when the cap 28 is converted into the open state.

Figure 2:
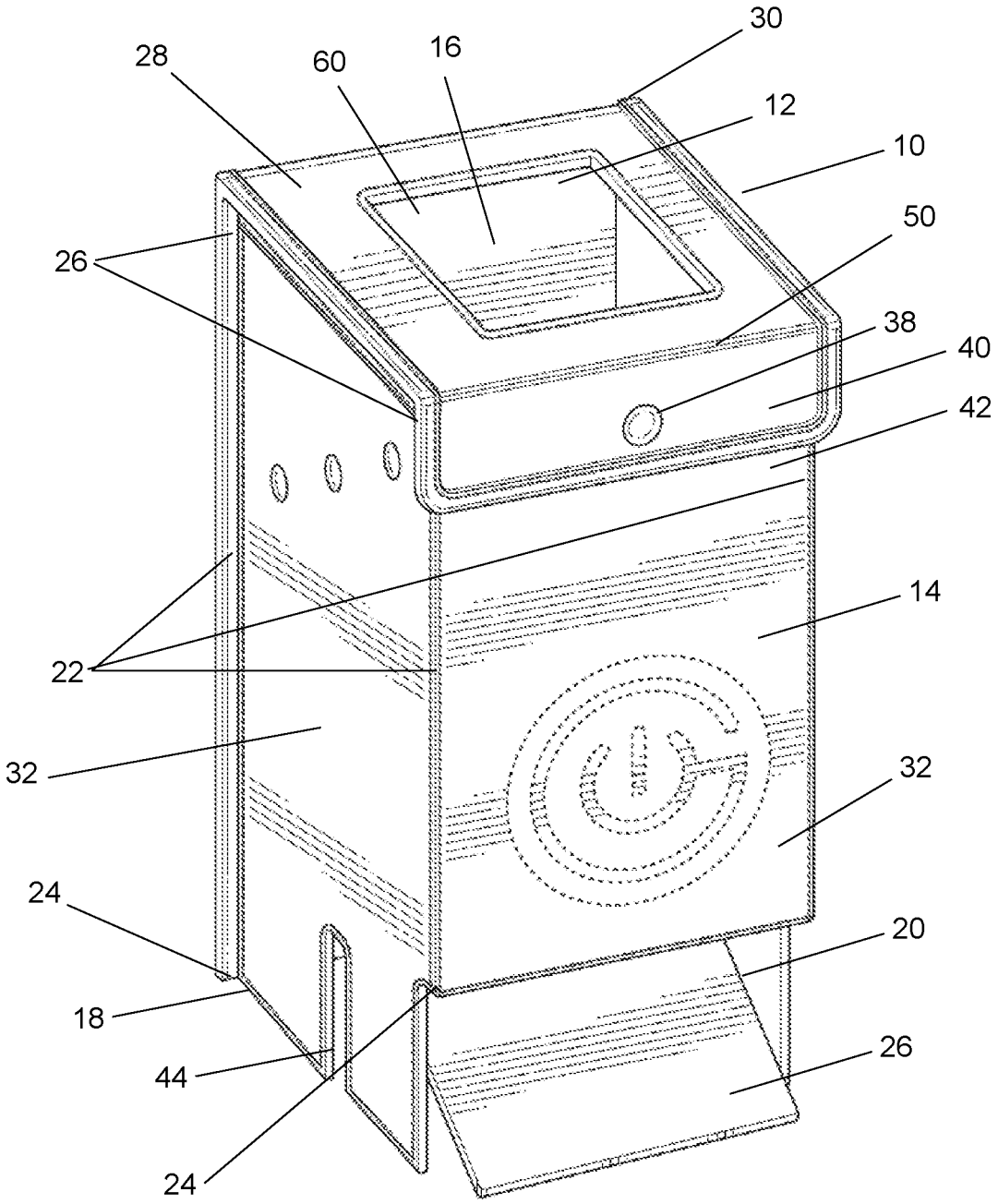
FIG. 2 is an elevated perspective view of the dice tower of the present invention.
Figure 3:
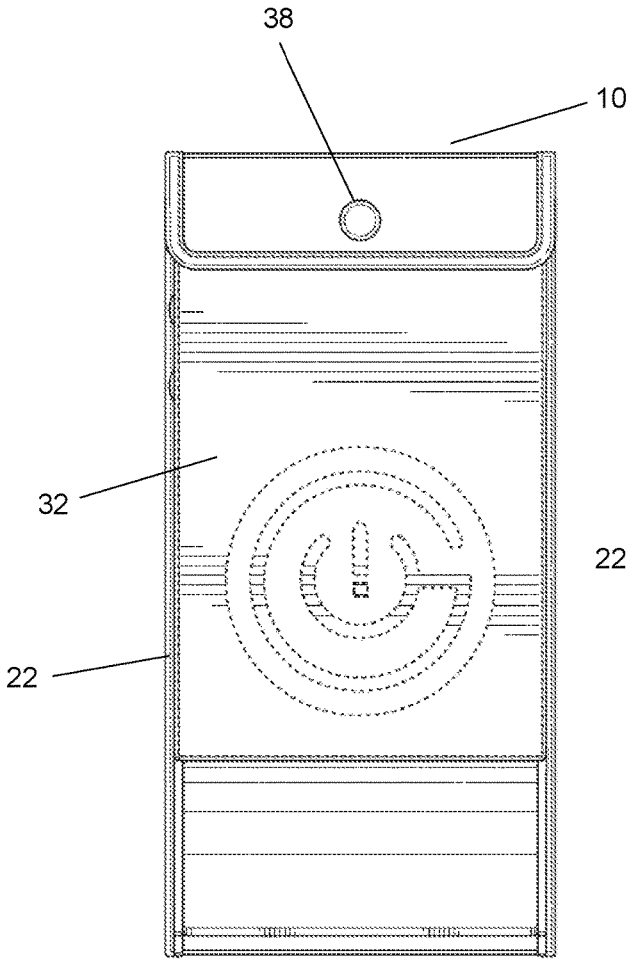
FIG. 3 is a front view of the dice tower of the present invention.
Figure 4:
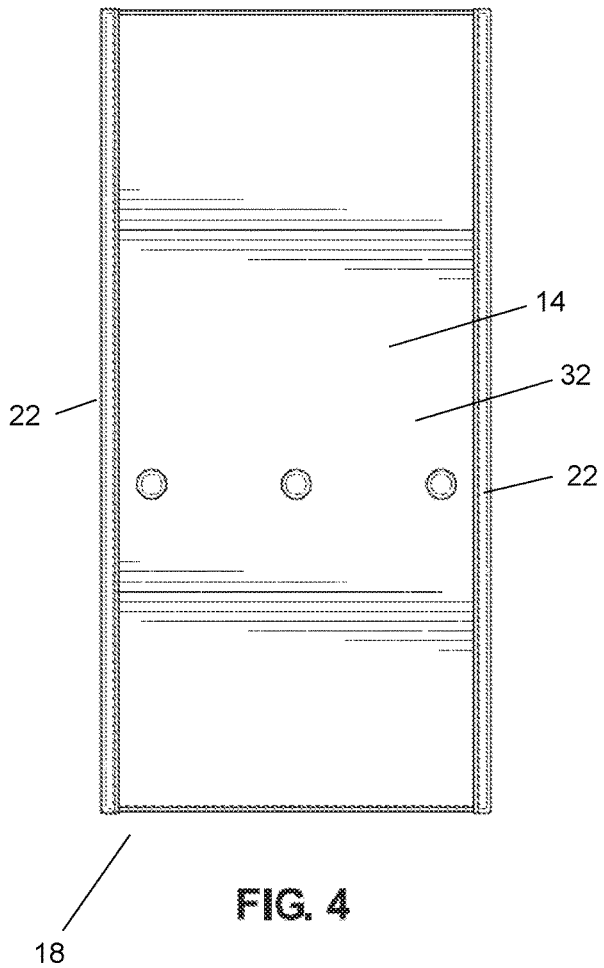
FIG. 4 is a back view of the dice tower of the present invention.
Figures 5, 6:
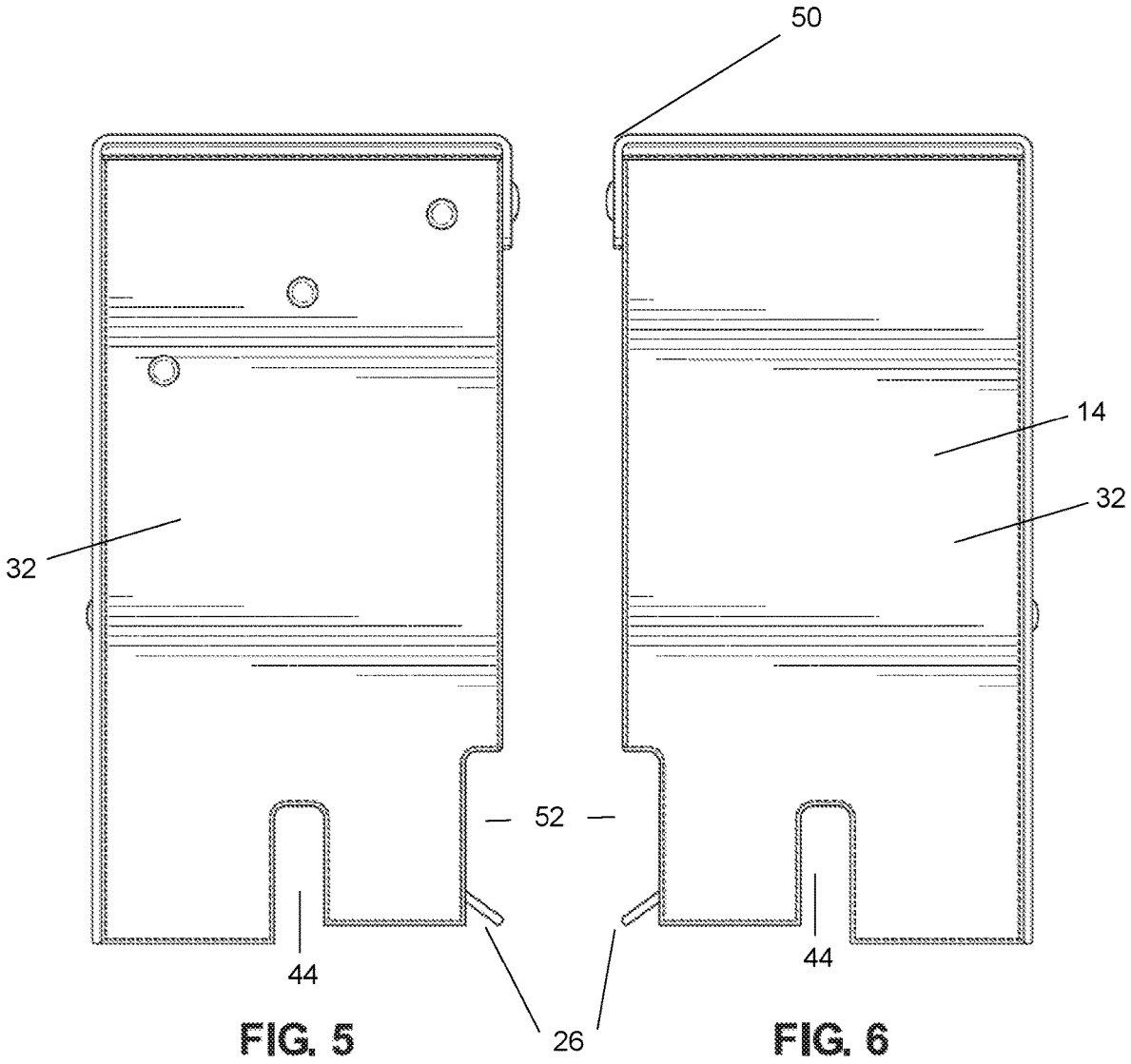
FIG. 5 is a left side view of the dice tower of the present invention.
FIG. 6 is a right side view of the dice tower of the present invention.
Figure 7:
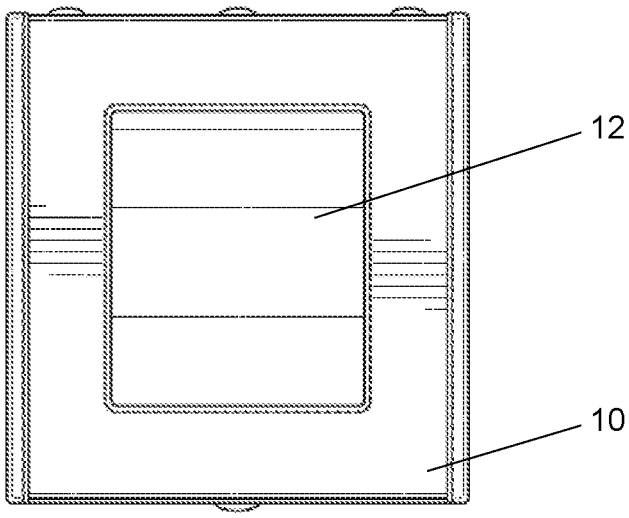
FIG. 7 is a top view of the dice tower of the present invention.
Figure 8:
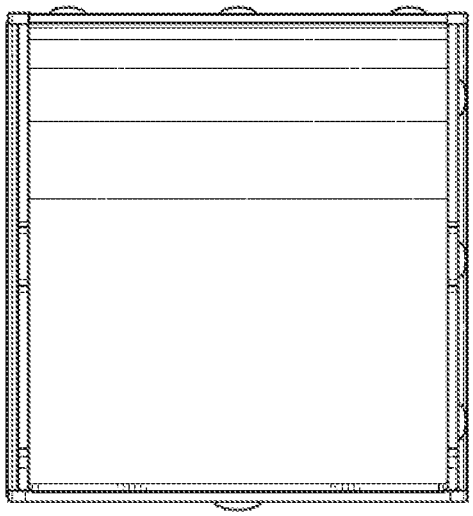
FIG. 8 is a bottom view of the dice tower of the present invention.

Still further, in certain embodiments, the cap 28 will preferably include a mechanical engagement 38 located on a flap portion 40 of the cap 28. The mechanical engagement 38 is preferably configured to reversibly connect the flap portion 40 of the cap 28 to an external surface 42 of the body section 14. More particularly, the invention provides that the cap 28 will preferably include a top area that houses the first opening 12, while the flap portion 40 will include an area along one side of the cap 28 (namely, the front side), which is perpendicular (or approximately perpendicular) to the top area that houses the first opening 12. The flap portion 40 is configured to rest adjacent to the external surface 42 of the body section 14 when the dice tower exists in an operable state (FIGS. 1 and 2). In addition, the invention provides that the flap portion 40 of the cap 28 will preferably include its own hinge 50, which allows the flap portion 40 and top area of the cap 28 that houses the first opening 12 to exist in the same plane (or approximately the same plane), when the dice tower is converted into a flattened state (FIG. 9). The invention provides that the mechanical engagement 38 may include mechanical snaps, loop and hook materials (e.g., Velcro®), magnets, and other mechanisms for reversibly attaching one area/surface to another.

According to yet further preferred embodiments, the body section 14 may include a recessed area 44 (FIGS. 5 and 6) within the bottom-most area of at least two sides 32 of the body section 14, with the recessed areas 44 being configured to receive and nestably mate with a lip or perimeter wall 46 of a dice tray 48 (FIG. 1). In addition, the invention provides that the body section 14 may include a cut-out area 52 (FIGS. 5 and 6) within the bottom-most area of at least two sides 32 of the body section 14, with the cut-out area 52 being contiguous with the second opening 20. The invention provides that such cut-out area 52 may facilitate expulsion of the dice from the second opening 20, i.e., to prevent the dice from becoming stuck near the second opening 20 and slanted platform 26.

According to the embodiments described and illustrated herein, the dice towers are converted into an operable position (FIG. 1) by maneuvering the sides 32 of the body section 14 into an open position—e.g., in the case of the dice tower illustrated herein, maneuvering the sides 32 of the body section 14 into a rectangular orientation. Next, the cap 28 is rotated along its first hinge 30 to a position that is perpendicular (or approximately perpendicular) to the sides 32 of the body section 14. In addition, the flap portion 40 of the cap 28 is rotated along its own hinge 50, to a point that the mechanical engagement 38 is able to be reversibly attached to the exterior surface 42 of the side 32 (i.e., the front side of the dice tower). In addition, the slanted platform 26 will be rotated (along its own hinge/axis), to exhibit an angular position (relative to a table surface, floor surface, or the surface of a dice tray 48), such that the angled/slanted platform 26 will be oriented to propel dice out from the second opening 20. Once the mechanical engagement 38 is reversibly attached to the exterior surface 42 of the side 32 (e.g., snapped together), the dice tower will be locked into position and configured to rest on its own, and be used for rolling dice, without external structural support.

Figure 10:
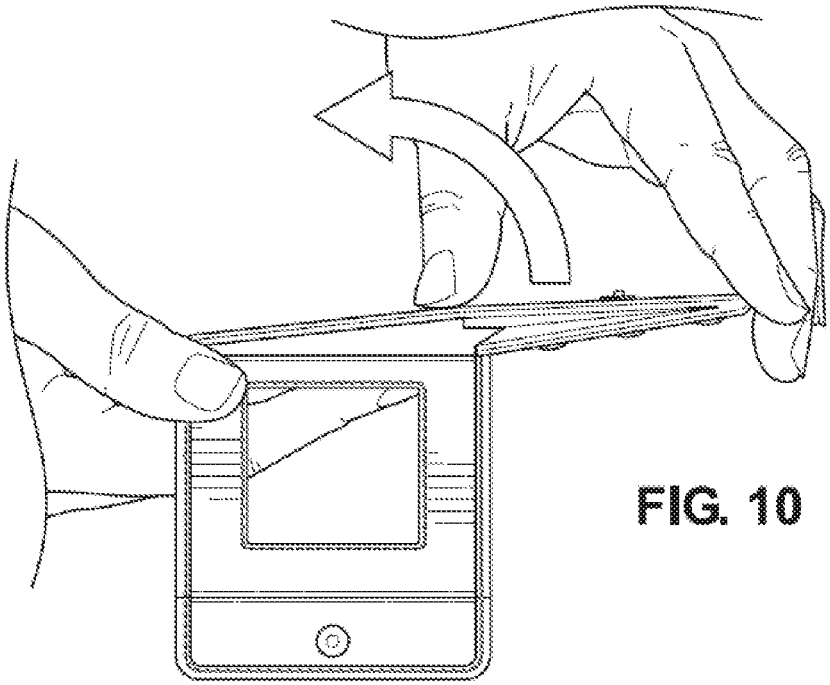
FIG. 10 is a top view showing disengagement and opening of the dice tower cap.
Figure 11:
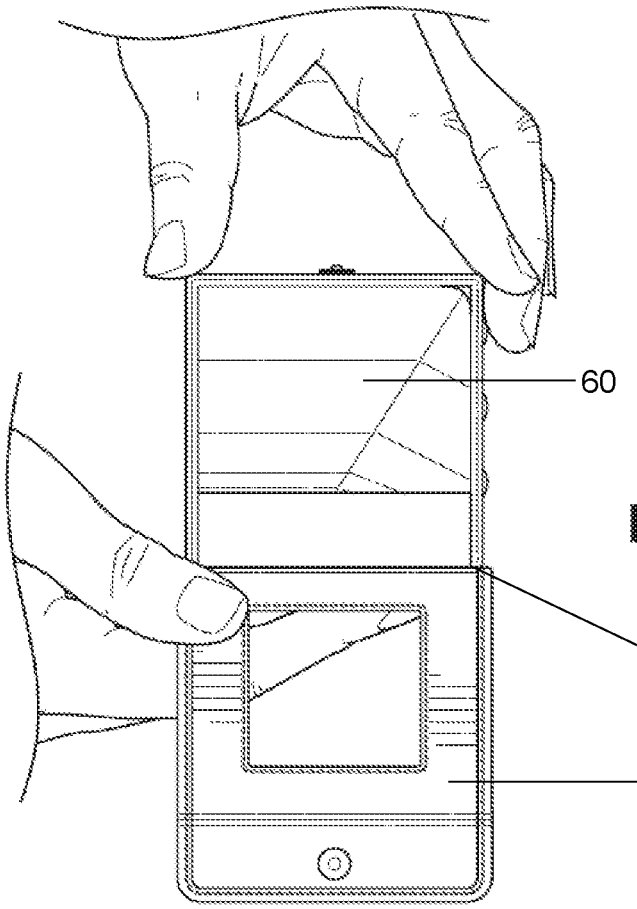
FIG. 11 is a top view showing the dice tower cap in a disengaged/open state.

In order to convert the dice tower into a flattened state (FIG. 9), the mechanical engagement 38 is reversibly disengaged from the exterior surface 42 of the side 32 (e.g., unsnapped)(FIGS. 10 and 11). At this point, the cap 28 (and flap portion 40 thereof) are allowed to rotate open. In addition, the sides 32 of the body section 14 are allowed to be manually maneuvered and folded along the series of hinges 22 to achieve the flattened state illustrated in FIG. 9. In addition, as mentioned above, the series of hinges (e.g., creases) within the internal ramp 60 enable the ramp 60 to automatically fold into a flattened state, as the rest of the dice tower is converted into a flattened state as described herein (i.e., the ramp 60 is configured to exhibit a sort of origami design and functionality).

The invention provides that the dice towers described herein may be comprised of any suitably rigid material. Non-limiting examples of such materials include cardboard, plastics, elastomers, rubbers, wood, metals, or combinations of such materials.

According to additional embodiments of the present invention, dice tower and dice tray assemblies are provided. More particularly, in such embodiments, the invention further encompasses dice trays 48 and the dice towers described herein being packaged and sold together. Still more particularly, the assemblies of the present invention include dice trays 48 that are configured to be nestably and reversibly attached to the recessed areas 44 of the dice towers, as described herein.

The many aspects and benefits of the invention are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A dice tower, which comprises:

(a) a top end having a first opening that is configured to receive dice;

(b) a body section that includes an internal area that is contiguous with the first opening of the top end; and (c) a bottom end having a second opening that is contiguous with the internal area and is configured to expel dice that have been dropped into the first opening, wherein the dice tower is configured to reversibly fold into a flattened state during non-use, wherein:

(i) the bottom end includes a slanted platform, which is configured to make contact with the dice and project the dice forward and out of the second opening; and (ii) the top end further includes a cap, wherein the cap includes a first hinge and the first opening, wherein the cap is configured to reversibly swing into an open state and a closed state along the first hinge.

2. The dice tower of claim 1, wherein the body section includes a plurality of sides, with each of said plurality of sides having a folding hinge that runs from a bottom point to a top point of each of said plurality of sides.

3. The dice tower of claim 2, wherein the folding hinge of each of said plurality of sides is configured to allow the body section to fold into the flattened state when the cap is converted into the open state.

4. The dice tower of claim 3, wherein the cap includes a mechanical engagement located on a flap portion of the cap, wherein the mechanical engagement is configured to reversibly connect the flap portion of the cap to an external surface of the body section.

5. The dice tower of claim 4, wherein the body section includes four sides.

6. The dice tower of claim 5, which further comprises a recessed area within a bottom-most area of two of the four sides, wherein the recessed area is configured to receive and nestably mate with a perimeter wall of a dice tray.

7. The dice tower of claim 6, which further comprises a ramp located within the internal area of the body section, and near the first opening, wherein the ramp includes one or more hinges or creases that enable the ramp to automatically (a) spread out when the dice tower is converted into an operable configuration and (b) collapse into a flattened state when the dice tower is converted into the flattened state during non-use.

8. A dice tower and dice tray assembly, which comprises a dice tray and a dice tower, wherein the dice tower comprises:

(a) a top end having a first opening that is configured to receive dice;

(b) a body section that includes an internal area that is contiguous with the first opening of the top end; and (c) a bottom end having a second opening that is contiguous with the internal area and is configured to expel dice that have been dropped into the first opening, wherein the dice tower is configured to reversibly fold into a flattened state during non-use, wherein:

(i) the bottom end includes a slanted platform, which is configured to make contact with the dice and project the dice forward and out of the second opening; and (ii) the top end further includes a cap, wherein the cap includes a first hinge and the first opening, wherein the cap is configured to reversibly swing into an open state and a closed state along the first hinge.

9. The dice tower and dice tray assembly of claim 8, wherein the body section includes a plurality of sides, with each of said plurality of sides having a folding hinge that runs from a bottom point to a top point of each of said plurality of sides.

10. The dice tower and dice tray assembly of claim 9, wherein the folding hinge of each of said plurality of sides is configured to allow the body section to fold into the flattened state when the cap is converted into the open state.

11. The dice tower and dice tray assembly of claim 10, wherein the cap includes a mechanical engagement located on a flap portion of the cap, wherein the mechanical engagement is configured to reversibly connect the flap portion of the cap to an external surface of the body section.

12. The dice tower and dice tray assembly of claim 11, wherein the body section includes four sides.

13. The dice tower and dice tray assembly of claim 12, which further comprises a recessed area within a bottom-most area of two of the four sides, wherein the recessed area is configured to receive and nestably mate with a perimeter wall of the dice tray.

14. The dice tower and dice tray assembly of claim 13, which further comprises a ramp located within the internal area of the body section, and near the first opening, wherein the ramp includes one or more hinges or creases that enable the ramp to automatically (a) spread out when the dice tower is converted into an operable configuration and (b) collapse into a flattened state when the dice tower is converted into the flattened state during non-use.

* * * * *